US006062707A

United States Patent [19]

Wang

[11] Patent Number: 6,062,707

[45] Date of Patent: May 16, 2000

[54] FRAME WITH JOINING MEANS FOR HANGING CHRISTMAS LIGHT BULB SERIES

[76] Inventor: Jung Kuei Wang, No. 2, Lane 60, Kuang Hua 1st Street, Hsinchu, Taiwan

[21] Appl. No.: 09/233,432

[22] Filed: Jan. 20, 1999

[51] Int. Cl.[7] ..... F21V 21/00

[52] U.S. Cl. ..... 362/249; 362/123; 362/252; 362/806

[58] Field of Search ..... 362/249, 123, 362/252, 806

[56] References Cited

U.S. PATENT DOCUMENTS 5,712,770 1/1998 Huang ..... 362/252

5,803,591 9/1998 Lin ..... 362/226

*Primary Examiner*—Sandra O'Shea
*Assistant Examiner*—Ali Alavi
*Attorney, Agent, or Firm*—Rosenberg, Klein & Lee

[57] ABSTRACT

The present invention relates to a frame structure with a joining mechanism for hanging a Christmas light bulb series. It mainly provides an innovative frame structure that makes use of an engagement between the pins of a light bulb holder and the voids of the frame to secure the bulb elements of the light bulb series. The frame has slots disposed thereon and positioned in alignment with the light bulbs of the Christmas light bulb series so that the light beams of light bulbs can pass through these slots to show more attraction.

2 Claims, 3 Drawing Sheets

FRAME WITH JOINING MEANS FOR HANGING CHRISTMAS LIGHT BULB SERIES

BACKGROUND OF THE INVENTION

In a prior art, Christmas light bulb series are usually attached to a frame having specified forms. The owner wishes to make use of the illumination of the light bulb series on the frame to express a special image or decorative effect. The attachment mechanisms used in a prior art are typically winding the light bulb series around the frame as well as interlocking light bulb sets of the light bulb series with the frame. In such arrangements, light bulbs are usually affixed to the same side of a frame, none on the opposite side. As a result, such designs weaken the decorative effect of the light bulb series. Besides, in another prior art arrangement, the frame has larger openings housing light bulb sets. Therefore, light bulbs easily get out of position and the combination is not dependable. Furthermore, the assemblage is rather tedious and causes inconvenience in manufacturing.

In view of the above problems, the primary object of the invention is to provide a frame structure with a joining mechanism for hanging Christmas light bulb series in which the shortcomings of a conventional structure have been eliminated. The structure according to the invention can secure light bulb sets in an easy way and allows light bulbs to diffuse their light beams to two sides so that the structure can get an enhanced decorative effect. Now the structural features and advantages of the invention will be described in detail with reference to the accompanying drawings.

BRIEF DESCRIPTION OF THE ACCOMPANYING DRAWINGS

DETAILED DESCRIPTION OF THE PREFERRED EMBODIMENTS

Figure 1:
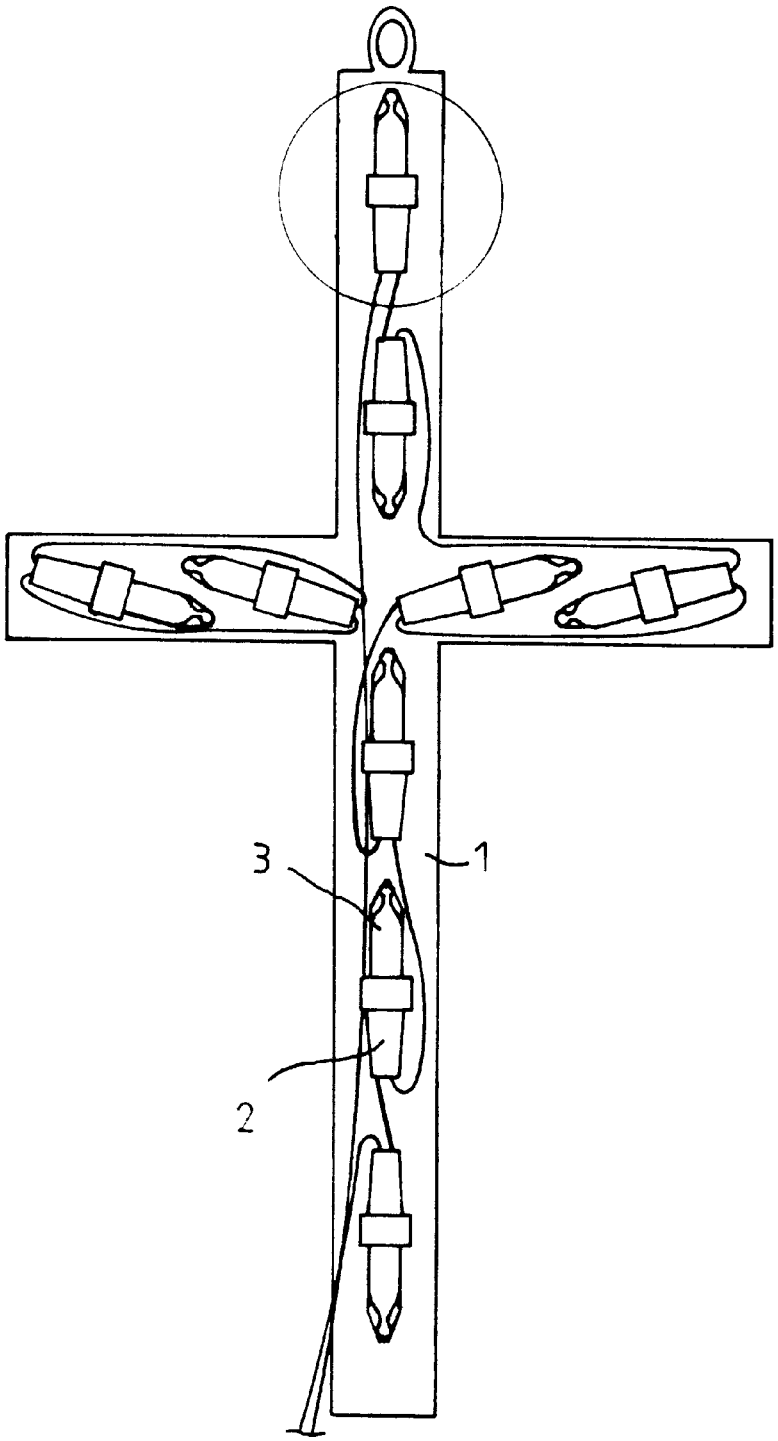
FIG. 1 is a plan view showing a frame according to the invention, to which Christmas light bulb series are attached.
Figure 3:
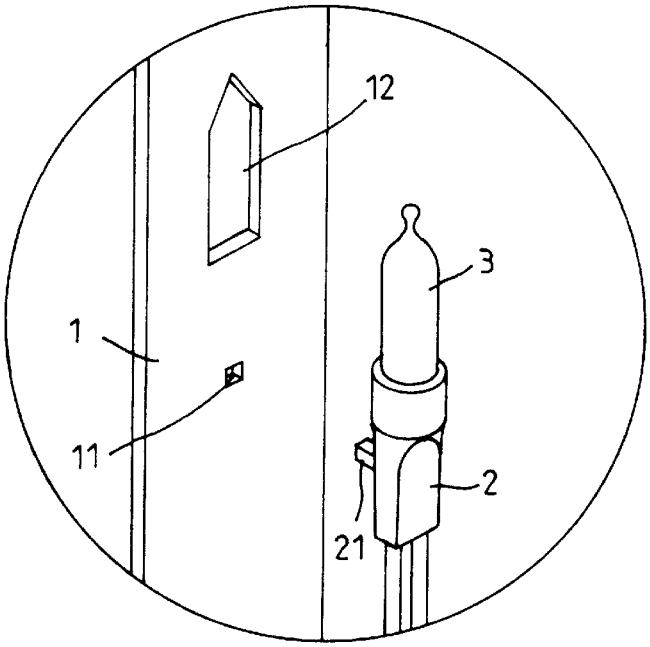
FIG. 3 is an exploded view of the frame shown in FIG. 2.
Figure 2:
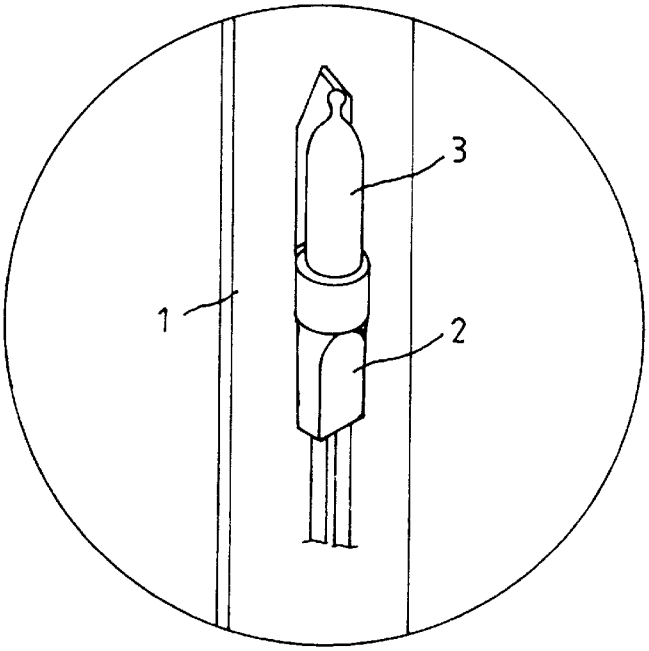
FIG. 2 is a partial enlarged view of the frame of FIG. 1.
Figure 4:
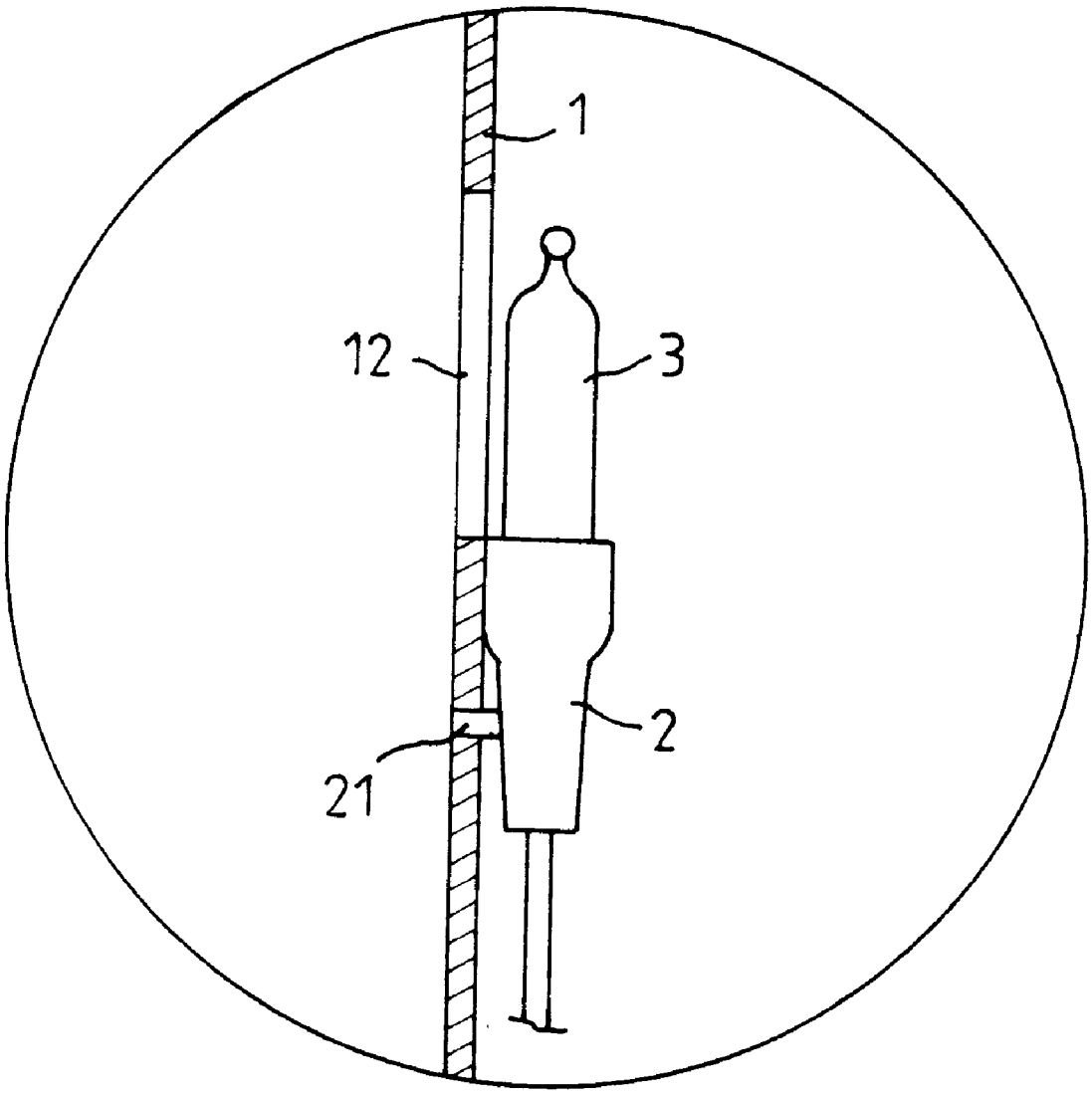
FIG. 4 is a cross sectional view of the frame shown in FIG. 2.

Referring to the accompanying drawings, the frame (1) according to the invention primarily has several pairs of openings formed thereon, each pair consisting of a square void (11) and a slot (12). The frame (1) can be of any desired form. According to the invention, each light bulb of the light bulb series links with a neighboring one through an electrical wire. Each light bulb holder (2) is provided with a square pin (21) on one side. By means of the insertion of the square pin (21) into the square void (11), the frame (1), can firmly secure the light bulb holder (2), with the light bulb (3) positioned in alignment with the slot (12).

With such an arrangement, each light bulb holder (2) can be attached to the frame (1) in an easy way. Further, the light beams of the light bulb (3) can pass through the slot (12) to reach the other side of the frame (1), obtaining a decorative effect that a conventional structure can not get.

The voids (11) of the frame (1) and the pins (21) of the light bulb holder (2) according to the invention can be triangular or polygonal in contour as long as their engagement is positive and effective. Hence, it is understood that the invention is not limited to the embodiments disclosed but is intended to embrace any modification or variation falling within the scope of the invention as defined by the following claims.

What is claimed is:

1. A frame structure with joining means for hanging Christmas light bulb series primarily comprises a frame that can be of various forms and that has several pairs of voids and slots formed thereon, and Christmas light bulb holders each of which has a pin disposed on one side and suitable for fit into said voids of the frame to form a firm engagement;

said void and slot being arranged in such a way that the light bulb is seated in a position aligned with said slot to let the light beams of the light bulb pass through the slot.

2. The frame structure as claimed in claim 1, wherein the voids of said frame and the pins of said light bulb holder are square or polygonal in contour so that they can be firmly coupled with each other.

* * * * *